United States Patent [19]

Koine

[11] Patent Number: 4,982,649

[45] Date of Patent: Jan. 8, 1991

[54] STRAIGHT-ACTION BREECH BLOCK SYSTEM

[75] Inventor: Richard Koine, Ratingen, Fed. Rep. of Germany

[73] Assignee: Rheinmetall GmbH, Düsseldorf, Fed. Rep. of Germany

[21] Appl. No.: 423,045

[22] Filed: Oct. 18, 1989

[30] Foreign Application Priority Data

Oct. 19, 1988 [DE] Fed. Rep. of Germany ..... 3835556

[51] Int. Cl.[5] ..... F41A 19/61

[52] U.S. Cl. ..... 89/28.05; 89/26; 89/185

[58] Field of Search ..... 42/84; 89/28.05, 135

[56] References Cited

U.S. PATENT DOCUMENTS 2,957,391 10/1960 Lovercheck ..... 89/28.05

3,580,113 5/1971 Ramsay ..... 42/84

3,969,983 7/1976 Zellweger et al. ..... 89/185

*Primary Examiner*—Stephen C. Bentley

*Attorney, Agent, or Firm*—Spencer & Frank

[57] ABSTRACT

A tubular automatic weapon includes a barrel having a rear terminal portion defining a chamber, and a breech block having a breech block axis and being arranged for movement in axial alignment with the barrel. The breech has a block housing, a rotary head; an iron core secured within the head; a permanent magnet situated within the head and being movable relative to the iron core in inductive relationship therewith; an energy accumulator for storing the kinetic energy derived from the motion of the housing towards a rearward position; and a coupling arrangement for connecting the energy accumulator with the permanent magnet to cause the permanent magnet to be propelled forwardly relative to the iron core by the energy released by the energy accumulator, thereby generating a magnetic field for inducing an igniting current in a cartridge situated in the chamber.

15 Claims, 3 Drawing Sheets

10
11
12
13
14
15
16
18
20
22
24
26
28
30
32
34
36
38
40
42
44
46
48
50
52
54
56
58
60
62
64
66
68
70
72
74
76
78
80
82
IV
V
VI

FIG.2a
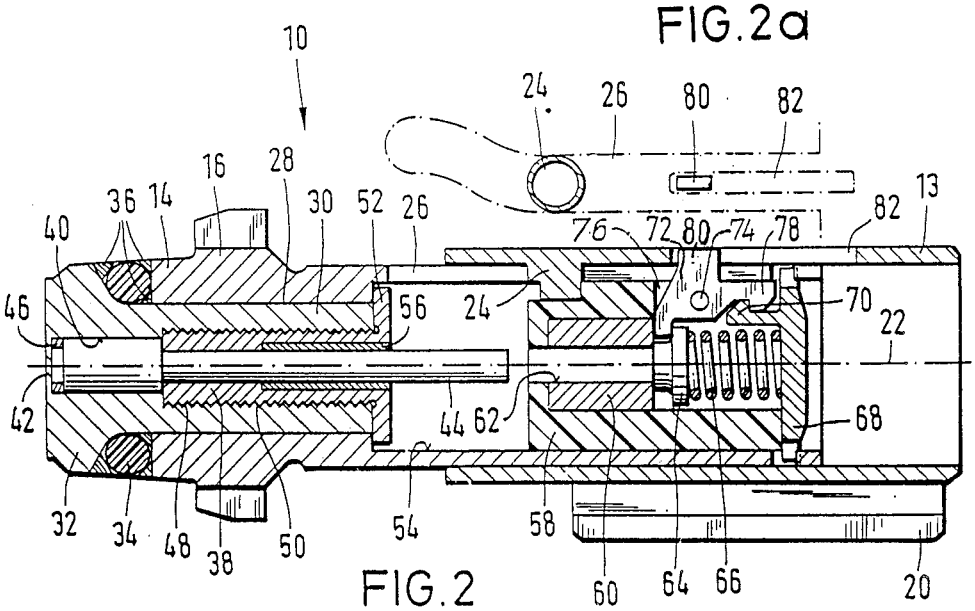
FIG.2
FIG.3a
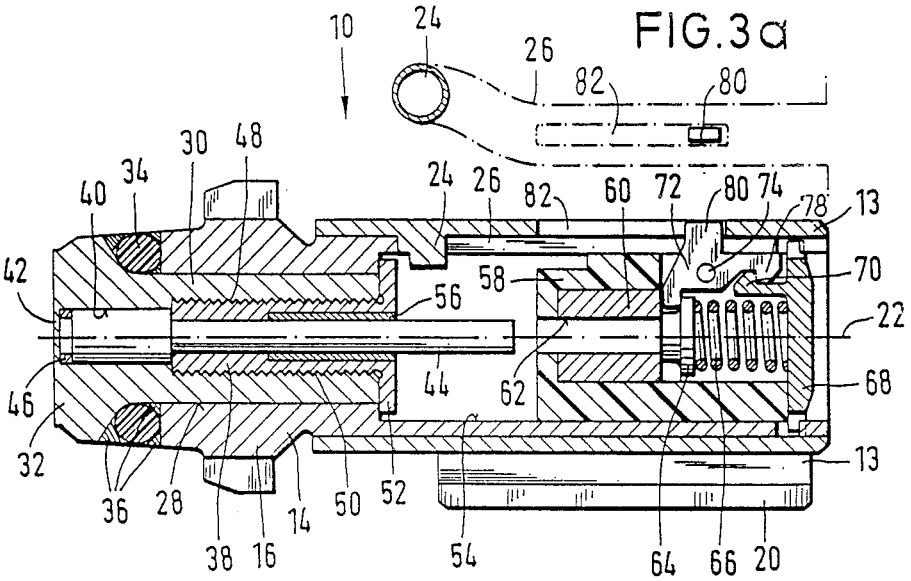
FIG.3

STRAIGHT-ACTION BREECH BLOCK SYSTEM

CROSS REFERENCE TO RELATED APPLICATION

This application claims the priority of Federal Republic of Germany Application No. P 38 35 556.6 filed Oct. 19th, 1988, which is incorporated herein by reference.

BACKGROUND OF THE INVENTION

The present invention relates to a straight-action breech block system for a tubular automatic weapon. The breech block system is of the type which has a housing and a rotary head guided therein for a longitudinal and rotational movement. The rotary head is provided with a locking member having external teeth to provide a bayonet-like lock for the breech block in an internally toothed region at the end of the gun barrel. The breech block system further includes an inductive ignition device integrated in the breech block for igniting a cartridge disposed in a chamber of the gun barrel.

A breech block assembly of the above-outlined type is disclosed, for example, in German Patent No. 2,443,044 to which corresponds U.S. Pat. No. 3,969,983. The breech block assembly disclosed therein includes a housing accommodating a head provided with a locking flange having external circumferential teeth. In order to lock the breech block the rotary head is able to engage in a mating toothed flange which is associated with the gun barrel and which has internal teeth offset by one tooth pitch. A firing pin is provided in the rotary head to ignite a cartridge disposed in the chamber of the gun barrel according to the percussion ignition principle.

Such a breech block however, is not suitable for use with ammunition without metal casings (caseless, cartridged ammunition) since a firing pin of the above-described type, in view of the firing stresses acting thereon, is subject to substantial wear and may cause a cook-off of the subsequently supplied caseless cartridges. In the prior art identified above, the sealing problems occurring when firing caseless, cartridged ammunition, compared to ammunition having metal casings, are not considered, so that the disclosed breech block assembly does not have a suitable sealing configuration.

While, in order to improve the ignition of caseless ammunition, electrical ignition means have been proposed for such breech block systems, because of the back and forth movement of the breechblock, problems of supplying the required electrical energy from an energy source external to the weapon are encountered. In addition to the general problems of supplying the breech block assembly with electrical energy, an electrical contact pin ignition is unsuitable for caseless ammunition since such a contact pin, similarly to the percussion ignition pin, wears easily and tends to become scaly which, in turn, prevents clean contacting and increases the susceptibility to malfunctions.

SUMMARY OF THE INVENTION

It is an object of the invention to provide an improved straight-action breech block system for a tubular automatic weapon, particularly for firing caseless, cartridged ammunition, which is able to operate without an electrical energy source external of the weapon but utilizes the advantages of an electrical ignition.

This object and others to become apparent as the specification progresses, are accomplished by the invention, according to which, briefly stated, the tubular automatic: weapon includes a barrel having a rear terminal portion defining a chamber, and a breech block having a axis and being arranged for movement in axial alignment with the barrel. The breech block has a housing, a rotary head; an iron core secured within the head; a permanent magnet situated within the head and being movable relative to the iron core in inductive relationship therewith; an energy accumulator for storing the kinetic energy derived from the motion of the housing towards a rearward position; and a coupling arrangement for connecting the energy accumulator with the permanent magnet to cause the permanent magnet to be propelled forwardly relative to the iron core by the energy released by the energy accumulator, thereby generating a magnetic field for inducing an igniting current in a cartridge situated in the chamber.

The particular advantage of the invention resides in that, in order to activate the ignition of a caseless cartridge, it provides an induction stage which is integrated in the breech block system and whose induction current pulse is generated by an energy accumulator which operates as a pulse generator and is likewise integrated in the breech block system. The stored energy is derived solely from the movement of the breech block system. The present invention thus avoids, in particular, electrical conductors which would be required if external electrical energy were supplied to the breech block assembly and which, due to the back and forth movement of the breech block assembly, would have to compensate for the stroke of the latter, increasing its susceptibility to malfunction.

According to a further feature of the invention, the above-described ignition configuration is combined with a mushroom-shaped obturator (a sleeve having a diametrically enlarged head) disposed in the breech block system. The obturator has soil and damage compensating characteristics and may be positioned in a simple manner in the sealing position of the breechblock and further has a low breech block face force which is a function of its surface area. Additionally, between firing intervals, such a sealing configuration is able to dissipate heat by convection.

BRIEF DESCRIPTION OF THE DRAWING

FIG. 2 is an axial sectional view of the preferred embodiment shown in an unlocked state with the energy for ignition applied.

FIG. 2*a* is a schematic, symbolic top plan view of some of the components illustrating their relative position depicted in FIG. 2.

FIG. 3 is an axial sectional view of the preferred embodiment shown during a locking phase with the energy for ignition applied.

FIG. 3*a* is a schematic, symbolic top plan view of some of the components illustrating their relative position depicted in FIG. 3.

DESCRIPTION OF THE PREFERRED EMBODIMENT

Figures 1, 1A:
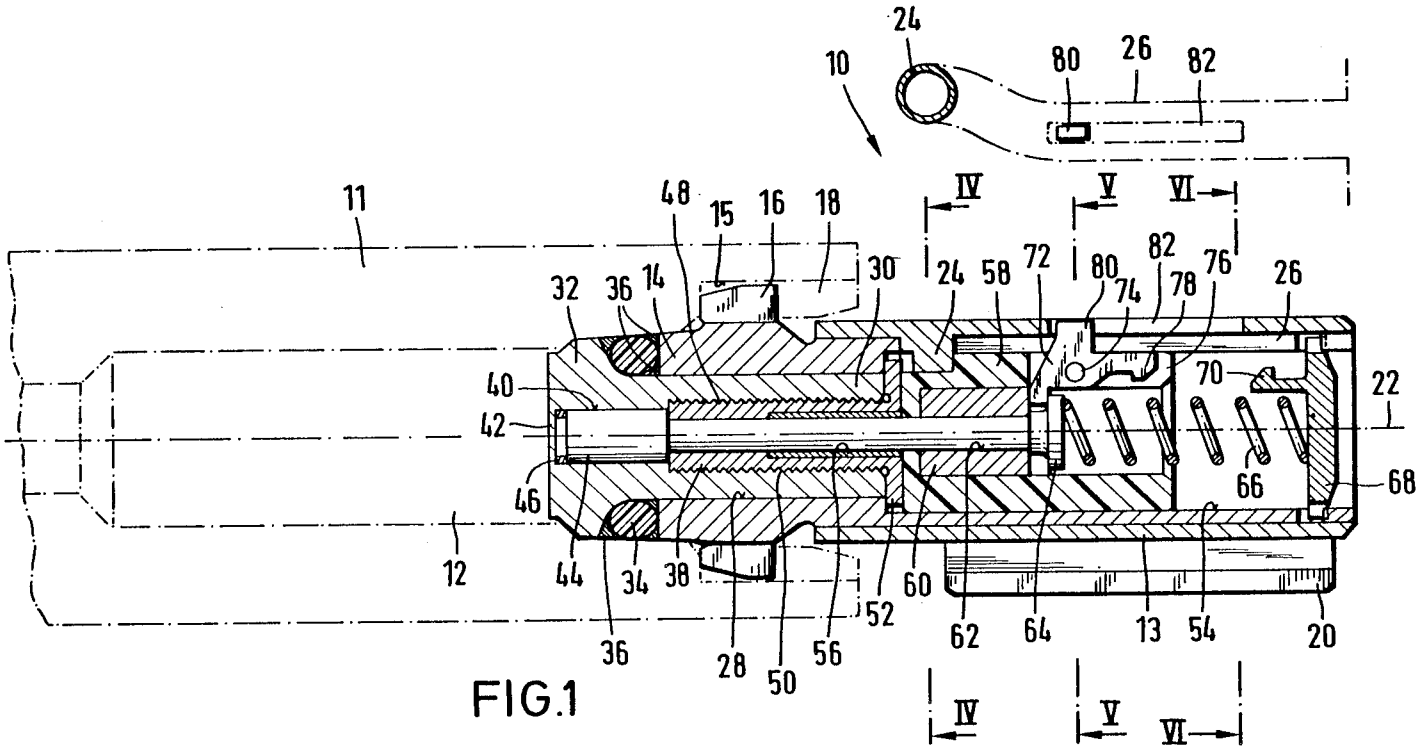
FIG. 1 is an axial sectional view of a straight-action breech block system according to a preferred embodiment of the invention in the locked state after the energy required for ignition has been released.
FIG. 1*a* is a schematic, symbolic top plan view of some of the components illustrating their relative position depicted in FIG. 1.

FIG. 1 shows a straight-action breech block system 10 according to a preferred embodiment of the invention in a gun barrel 11 indicated only in phantom lines and including a chamber 12. In a housing 13 of breech block system 10, a rotary head 14 is disposed so as to be movable longitudinally and rotationally. The rotary head 14 is provided with a circumferential, preferably eight-toothed locking comb 16 which, in order to lock the breech block passes in a known manner through a likewise eight-toothed internal tooth arrangement 18 formed in the gun barrel 11 and offset by one tooth pitch, to then enter into an undercut groove 15 in the gun barrel 11. After a subsequent turning movement of the rotary head 14 by approximately 22.5° (corresponding to the selected tooth pitch), which movement is derived from the linear forward movement of the housing 13, the teeth of the locking comb 16 of the rotary head 14 lie in the groove 15 of the gun barrel 11 against the internal teeth 18 of the gun barrel 11, whereby the breech block is locked.

Figure 4:
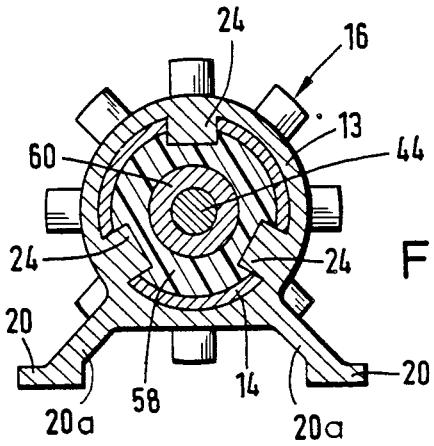
FIG. 4 is a sectional view taken along line IV—IV of FIG. 1.
Figure 5:
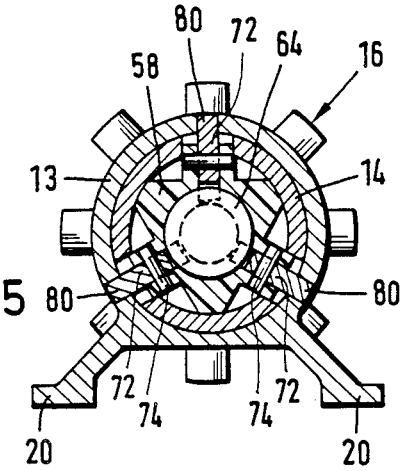
FIG. 5 is a sectional view taken along line V—V of FIG. 1.
Figure 6:
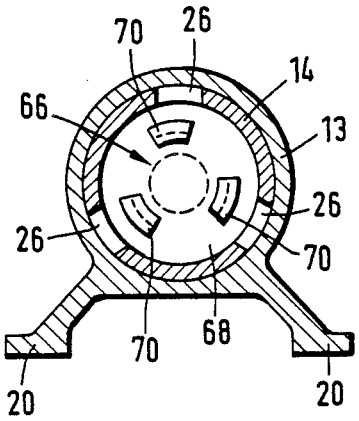
FIG. 6 is a sectional view taken along line VI—VI of FIG. 1.

For guiding the housing 13 during its linear movement parallel to a breech block axis 22 which, in all movement phases of the breech block is in alignment with the bore axis of the gun barrel 11, preferably two skids 20 are provided or the housing 13 (only one is visible in FIG. 1, while both are shown in FIGS. 4–6). Since the breech block system 10 according to the invention could be provided with any desired drive, an illustration of the drive for the breech block has been omitted for the sake of clarity.

The rotary movement required of the rotary head 14 to lock the breech block system 10 is effected by preferably three control cams 24 which —as also shown in FIGS. 4–6 —extend radially inwardly in housing 13. Each control cam 24 engages in an associated cam track 26 provided on the circumference of the rotary head 14. Schematic plan views of FIGS. 1*a*, 2*a* and 3*a* more clearly illustrate the cam track 26 and the relative position of the control cam 24 therein in the respective operational phases (locking movements) depicted in FIGS. 1, 2 and 3.

In a frontal, central bore 28 of the rotary head 14 a mushroom-shaped sleeve member 30 having a diametrically enlarged head 32 is longitudinally displaceable. Between a front shoulder of the rotary head 14 and the head 32 a sealing ring 34 is provided which is preferably made of a compressible material and which is supported at three sides by three filler rings 36. A threaded sleeve 38 is axially screwed into the member 30. The latter includes a blind bore 40 which is open rearwardly and which is arranged such that a certain wall thickness remains in the region of the breech block face 42. The sleeve member 30 and the threaded sleeve 38 are preferably made of a high-strength, non-magnetic material, such as a non-magnetic steel, type X5MnCr873, Standard No. 3949 according to German D/N -Standard.

A rod-shaped iron core 44 having a stepped diameter is inserted into the blind bore 40 of the sleeve member 30. The core 44 is machined in the region of its end face oriented toward the breech block face 42 and carries a copper ring 46. The rear region of the blind bore 40 is widened to form a central bore 48 which is provided with an internal thread matings with the externally threaded sleeve 38, whose outer end is provided with a collar 52 which extends beyond the diameter of the member 30 and thus limits the axial mobility thereof in the frontal central bore 28 of the rotary head 14. The threaded sleeve 38 accommodates the reduced-diameter portion of the iron core 44 and abuts a shoulder of the iron core 44 formed by the step in the member 30. This arrangement clamps the iron core 44 into the member 30. A rear length portion of that region of the iron core 44 which is received in the threaded sleeve 38, is surrounded by a tubular copper bushing 56.

The rear region of the rotary head 14 is provided with an axial bore 54 which accommodates a plastic sleeve 58 for sliding motion therein. In the interior of the plastic sleeve 58 a tubular permanent magnet 60 is provided whose central opening, together with a frontal connecting bore of corresponding diameter in the plastic sleeve 58, forms a central bore 62 for accommodating a rear portion of the iron core 44 and for enabling the permanent magnet 60 to be moved in the plastic sleeve 58 relative to the iron core 44.

In a central rear opening of the plastic sleeve 58, a spring seat disc 64 is provided on which a compression spring 66 is supported, whose other end is supported by a closure disc 68 of the rotary head 14. The closure disc 68 is preferably provided with three claws 70 which extend axially into the rotary head 14 and between which the compression spring 66 is accommodated, as seen in FIG. 6.

Each claw 70 is associated with a respective lever 72 pivotal about its pivot pin 74 in respective slot-like recesses 76 of the plastic sleeve 58, as seen in FIG. 5. The levers 72 are provided with claws 78 which, oriented toward the closure disc 68, cooperate with the claws 70 thereof, to form an automatic lock when the compression spring 66 is armed. Such a locking effect is realized in that the spring seat disc 64 charged by the compression spring 66, acts against corresponding lugs on the levers 72 and thus maintains the interengagement of the claws 70 with respective claws 78 as illustrated in FIGS. 2 and 3. To control the lock of claws 70 and 78 and to control the release of the energy stored in the armed compression spring 66 by releasing the lock formed by the claws 70 and 78, a cam 80 is formed on each lever 72. The cams 80 are guided in guide slots 82 provided in the cylindrical wall of the housing 13. FIGS. 1*a*, 2*a* and 3*a* illustrate the course of the cam 80 in the slot 82, as related to the cam track 26 in the rotary head 14, during locking and unlocking of the energy accumulator formed by the spring 66.

Reverting to FIG. 4, the teeth of the locking comb 16 of the rotary head 14 are shown as radially extending projections which protrude beyond the housing 13. The skids 20 for guiding housing 13 in the axial reciprocating movement required to load the cartridges are connected to the housing 13 by webs 20*a*. FIG. 4 further shows the three radially inwardly projecting control cams 24 of the housing 13 which project into cam tracks 26 provided on the circumference of the rotary head 14. Control cams 24 pass through the wall thickness of the rotary head 14 in the region of the cam tracks 26 and extend slightly farther into the interior of the breech block so that they are also able to engage in corresponding recesses in the plastic sleeve 58 to carry it along when the breech block is unlocked during its return movement.

FIG. 5 shows, in particular, the arrangement of the three levers 72 carried by the plastic sleeve 58 and rotatable about their pivot pins 74 extending transversely to the axis 22 of the breech block (see FIG. 1), so that each lever 72 can be moved in a plane containing the breech block axis 22. The cams 80 of each lever 72 pass through the cam tracks 26 in the rotary head 14 and into guide slots 82 of the housing 13. The guide slots 82 are in alignment with the cam tracks 26 in their axially parallel sections, as shown in FIGS. 1*a*, 2*a* and 3*a*. The compression spring 66 supported by the spring seat disc 64 is not shown in FIG. 5 for reasons of clarity. As shown in FIG. 5, the rear portion of the plastic sleeve 58 which carries the levers 72 has preferably an essentially triangular cross-sectional area. This measure simplifies mounting the levers 72 with their pivot pins 74 on the plastic sleeve 58.

FIG. 6 shows, in the housing 13, the closure disc 68 connected with the rotary head 14 and the three claws 70 attached thereto. Since the closure disc 68 is fastened to the rotary head 14, it participates in the pivoting movement of the rotary head 14 about the breech block axis 22 during the locking and unlocking phases of the breech block. For reasons of clarity, the compression spring 66 disposed between the claws 70 of the closure disc 68 is shown in FIG. 6 only as a dashed circle. The claws 70 are arranged offset relative to the claws 78 of the levers 72 in such a manner that the claws 70 are brought out of engagement during the pivoting movement of the rotary head 14 in the course of the locking phase and at the beginning of the unlocking phase.

The operation of the straight-action breech block system according to the invention will now be described with reference to FIGS. 1, 2 and 3 which show the sequence of movements.

In the forward position of the breech block 10 shown in FIG. 1, the reciprocating axial movement of the housing 13 performs a remainder or initial stroke relative to the rotary head 14, which is fixed by means of the control cams 24 in the cam track 26 and results in locking and unlocking of the breech block 10 by virtue of an oscillating turning movement by the rotary head 14 over 22.5° (because of the 8 teeth on the locking comb 16 and on the internal teeth 18 in gun barrel 11) about the breech block axis 22 relative to the gun barrel 11 and the housing 13. Such a rotary movement takes place because of the form-locking relationship between the control cams 24 affixed to the housing 13 and the cam tracks 26 provided in the rotary head 14. The form-locking pairing between the three control cams 24 and the three cam tracks 26 is distributed, as shown in FIG. 4, at three equal distances about the outer surface of the rotary head 14. In each phase the breech block axis 22 coincides with the axis of the gun barrel.

As shown in FIG. 1, when the rotary head 14 penetrates into the gun barrel 11, the mushroom-shaped sleeve member 30 is first limited in its movement by abutting the gun barrel 11. Upon further advance of the breech block 10 until it is locked, the locking comb 16 of the rotary head 14 limits its movement in the gun barrel 11. During this occurrence, the axial movement performed by the rotary head 14 relative to the member 30, results in a deformation of the sealing ring 34. Since, according to the invention, the sealing ring 34 is a compressible substance, it can be prestressed in this manner to assume a proper sealing position.

During the locking stroke of the breech block 10, the rotary head 14, as noted earlier, rotates relative to the housing 13 and thus also relative to the levers 72. Since the levers 72 are held in the guide slots 82 in the rotary head 14 by means of the cams 80, the rotary head 14 rotates about 22.5° about the breech block axis 22 relative to the levers 72. At the end of the locking stroke, that is, at the end of rotation of the rotary head 14, the previously present form-lock between the claws 70 of the closure disc 68 fixed to the housing 13 and the claws 78 of the levers 72 is released so that the plastic sleeve 58 and the permanent magnet 60 disposed therein snap forward under the force of the compression spring 66. This causes the permanent magnet 60 to be shifted concentrically over the iron core 44, inducing a temporary magnetic field in the iron core 44. The magnetic field is reinforced by the Thomson effect due to the advantageous arrangement according to the invention of the copper bushing 56 on the iron core 44 and the copper ring 46 in the front end of the sleeve member 30. The generation of the temporary magnetic field in the region of the breech block face 42 leads to the induction of an electrical current pulse in a conventional coil of a cartridge disposed in the cartridge chamber. As a result, the detonator charge of the cartridge is activated for firing a round.

As a round is fired, the build-up of gas pressure in the chamber 12 exerts a force on the breech block face 42 of the mushroom-shaped sleeve member 30 and, as a result, the latter moves relative to the rotary head 14, compressing the sealing ring 34. Due to the advantageous configuration of the mushroom-shaped sleeve member 30, a differential piston effect is achieved, so that the sealing forces exerted by the sealing ring 34, due to its compressibility, are augmented by virtue of pressure transfer. The support rings 36 arranged about the sealing ring 34 prevent the compressible substance of the sealing ring 34 from being squeezed through fitting clearances between the gun barrel 11 and the member 30, between the gun barrel 11 and the rotary head 14 and between the rotary head 14 and the member 30. As the gas pressure in the gun barrel 11 decays, the member 30 is able to move forward, whereupon the pressure forces in the sealing ring 34 are reduced. After the unlocking of the breech block 10 shown in FIG. 2 the sealing ring 34 is relaxed and assumes its original (unstressed) configuration.

Turning now to FIG. 2, the housing 13 which slides rearwardly when unlocked, entrains the plastic sleeve 58 —which is longitudinally displaceable in the rotary head 14 —by means of the control cams 24 which pass through the slot-shaped cam tracks 26 in the rotary head 14 and moves the levers 72 which are pivotally mounted in the plastic sleeve 58 against the closure disc 68 fixed in the rotary head 14. As a result, the claws 78 of the levers 72 engage behind the claws 70 of the closure disc 68 so that plastic sleeve 58 is retained at the closure disc 68 and the compression spring 66 is armed. Thereafter, the plastic sleeve 58 slides further back by a distance predetermined by the cams 80 of the levers 72 in the guide slots 82 of the housing 13, while the compression spring 66 remains armed due to the automatic lock between the claws 78 and the claws 70 and is in a standby state for a new round as energy accumulator for the inductive triggering device in the rotary head 14.

It will be understood that the above description of the present invention is susceptible to various modifications, changes and adaptations, and the same are intended to be comprehended within the meaning and range of equivalents of the appended claims.

What is claimed is:

1. In a tubular automatic weapon including a barrel having a rear terminal portion defining a chamber, and a breech block having a breech block axis and being arranged for movement in axial alignment with the barrel; said breech block having a housing and a head; said housing having a forward and a rearward position relative to the head; the improvement wherein said breech block further comprises (a) an iron core secured within said head;

(b) a permanent magnet situated within the head and being movable relative to the iron core in inductive relationship therewith;

(c) energy accumulating means for storing the kinetic energy derived from the motion of the housing towards said rearward position; and (d) coupling means for connecting said energy accumulating means with said permanent magnet to cause the permanent magnet to be propelled forwardly relative to said iron core by the energy released by said energy accumulating means, thereby generating a magnetic field for inducing an igniting current in a cartridge situated in said chamber.

2. A tubular automatic weapon as defined in claim 1, wherein said head includes cam tracks each having a curved and a linear length portion and further wherein said housing includes cams extending radially inwardly and projecting into respective said cam tracks; said cam tracks and said cam forming means for angularly and axially slidably guiding the head; further comprising a bayonet lock formed of locking teeth provided on said head and locking teeth provided on the rear terminal portion of the barrel for releasably locking the breech block to the barrel.

3. A tubular automatic weapon as defined in claim 1 further comprising skids carried on said block housing for guiding linear movements of said breech block parallel to said breech block axis.

4. A tubular automatic weapon as defined in claim 1, further comprising a sleeve received in said head coaxially therewith and projecting axially beyond a frontal end of the head; said sleeve having a rearwardly open blind axial bore and a frontal terminal portion defining a breech block face obturating said chamber in a closed position of the breech block said iron core extending within and coaxially with the blind bore.

5. A tubular automatic weapon as defined in claim 4, wherein said sleeve is a first sleeve; further comprising a second, plastic sleeve received in said head rearwardly of said first sleeve; said plastic sleeve being axially slidable to execute forward and rearward motions relative to said first sleeve and said housing; said permanent magnet being received in said plastic sleeve and being affixed thereto for movement with said plastic sleeve as a unit.

6. A tubular automatic weapon as defined in claim 5, wherein said energy accumulating means includes a compression spring positioned within said breech head; further comprising a spring seat disc held in said plastic sleeve and a closure disc obturating an open rearward end of said housing; said compression spring being positioned between and engageable by said spring seat disc and said closure disc.

7. A tubular automatic weapon as defined in claim 6, further comprising a lever pivotally secured to said plastic sleeve for pivotal motion in a plane containing said breech block axis; said lever having a first claw formed thereon; further comprising a second claw mounted on said closure disc and cooperating with said first claw for assuming an interlocking relationship therewith to releasably lock said plastic sleeve to said closure disc in a compressed state of said compression spring.

8. A tubular automatic weapon as defined in claim 7, wherein said lever has a cam and further wherein said housing has a guide slot receiving said cam for guiding said plastic sleeve during displacements thereof relative to said housing.

9. A tubular automatic weapon as defined in claim 4, wherein said sleeve is a first sleeve having an internal thread; further comprising a second sleeve having an external thread; said second sleeve being coaxially received in said first sleeve and being in a threaded engagement therewith; said iron core having a stepped portion defining an annular shoulder in said iron core; said second sleeve surrounding said iron core and having a frontal end abutting said annular shoulder for axially immobilizing said iron core within and relative to said first sleeve.

10. A tubular automatic weapon as defined in claim 9, wherein said first and second sleeves are of a high strength, non-magnetic material.

11. A tubular automatic weapon as defined in claim 9, wherein said second sleeve has an annular collar abutting a rearward end of said first sleeve for determining a screwed-in limit position of said second sleeve in said first sleeve.

12. A tubular automatic weapon as defined in claim 9, wherein said axial blind bore has a bottom separated by a wall thickness from the breech block face; further comprising a copper ring mounted at a front end of said iron core and being situated at the bore bottom; and a copper bushing mounted in said second sleeve and coaxially surrounding said iron core.

13. A tubular automatic weapon as defined in claim 4, wherein said frontal terminal portion of said sleeve includes a diametrically enlargement; further comprising a sealing ring surrounding said sleeve and being disposed between said enlargement and said frontal end of said head.

14. A tubular automatic weapon as defined in claim 13, further comprising three mutually spaced filler rings coaxially surrounding said sealing ring and being in contact therewith.

15. A tubular automatic weapon as defined in claim 13, wherein said sealing ring is of a compressible material.

* * * * *